US009084914B1

(12) United States Patent
Hoffman

(10) Patent No.: US 9,084,914 B1
(45) Date of Patent: Jul. 21, 2015

(54) DOOR MOUNTED EXERCISE APPARATUS

(71) Applicant: Ned Hoffman, Sebastopol, CA (US)

(72) Inventor: Ned Hoffman, Sebastopol, CA (US)

(73) Assignee: Holden Properties, LLC, Reno, NV (US)

( * ) Notice: Subject to any disclaimer, the term of this patent is extended or adjusted under 35 U.S.C. 154(b) by 117 days.

(21) Appl. No.: 14/034,496

(22) Filed: Sep. 23, 2013

Related U.S. Application Data

(60) Provisional application No. 61/730,254, filed on Nov. 27, 2012.

(51) Int. Cl.
*A63B 21/00* (2006.01)
*A63B 21/16* (2006.01)

(52) U.S. Cl.
CPC ..... *A63B 21/1627* (2013.01)

(58) Field of Classification Search
CPC ..... A63B 21/00
USPC ..... 482/904, 907, 121, 129
See application file for complete search history.

(56) References Cited

U.S. PATENT DOCUMENTS 6,322,483 B1 * 11/2001 Rotella ..... 482/129
2004/0087420 A1 * 5/2004 Montesquieux ..... 482/129

* cited by examiner

*Primary Examiner* — Jerome W Donnelly
(74) *Attorney, Agent, or Firm* — Antonio Papageorgiou, Esq.; Meister Seelig & Fein LLP

(57) ABSTRACT

A door-mounted exercise apparatus which includes: a first strap, measuring essentially 1.5 inches wide, essentially 73 inches long, and essentially 0.0625 inches thick, operable to removeably circumnavigate a door along its width, said first strap further including: a) a buckle operable to adjustably tighten the first strap circumferentially around the door's width, such that a user's feet can be inserted between the first strap and the door to securely adhere the feet up against a front or back surface of the door, and; b) a fastening device, said fastening device affixed to the first strap and operable to removeably fasten an elastic band to the first strap, such that the elastic band can be stretched by the user to exercise arm and leg muscles, wherein said fastening device includes any of the following: Velcro®; snap; button; buttonhole; carabiner; clip, and; ring; Whereby the door-mounted exercise apparatus enables the user to perform sit-ups and other muscle strengthening exercises.

15 Claims, 7 Drawing Sheets

DOOR MOUNTED EXERCISE APPARATUS

CROSS-REFERENCE TO RELATED APPLICATION

This utility patent application claims the benefit of provisional patent application Ser. No. 61/730,254, filed on Nov. 27, 2012, all of which is incorporated herein by reference.

FIELD OF THE INVENTION

The present invention relates to an exercise apparatus, and more specifically to a portable exercise apparatus for a plurality of exercises which removeably fastens to a door.

BACKGROUND OF THE INVENTION

The present invention, being a portable exercise apparatus, is designed to facilitate a variety of exercises while being removeably attachable to a door.

The home exercise market is well over $2 Billion annually in the U.S., with over 34% of Americans exercising on a frequent basis and over 35 Million Americans exercising in their homes (Sporting Goods Manufacturer's Association, 2008). Most home exercise equipment either targets one or two muscle groups, or, if targeting a variety of exercises, the equipment is often expensive, relatively heavy, and, while potentially moveable, is not genuinely portable. Further, most of such multi-muscle exercise equipment takes up floor space in the home, or is inconvenient to collapse and remove on a daily basis.

Therefore, there is a strong need for an improved portable exercise apparatus, which is low-cost, lightweight, flexible, attachable to a door, and conveniently collapsible so that it can be easily stored away or transported for travel.

The present invention addresses these needs, wherein still further objectives and advantages of this invention will become apparent from a consideration of the ensuing description and drawings.

SUMMARY OF THE INVENTION

The present invention satisfies these needs by providing an improved portable exercise apparatus or assembly.

In an embodiment of the invention, a door-mounted exercise apparatus comprises: a first strap, measuring essentially 1.5 inches wide, essentially 73 inches long, and essentially 0.0625 inches thick, operable to removeably circumnavigate a door along its width, said first strap further comprising: a) a buckle operable to adjustably tighten the first strap circumferentially around the door's width, such that a user's feet can be inserted between the first strap and the door to securely adhere the feet up against a front or back surface of the door, and; b) a fastening device, said fastening device affixed to the first strap and operable to removeably fasten an elastic band to the first strap, such that the elastic band can be stretched by the user to exercise arm and leg muscles, wherein said fastening device comprises any of the following: Velcro®; snap; button; buttonhole; carabiner; clip, and; ring; Whereby the door-mounted exercise apparatus enables the user to perform sit-ups and other muscle strengthening exercises.

In another embodiment of the invention, the exercise apparatus further comprises a second strap affixed to the first strap along the first strap's length, said second strap measuring essentially 16 inches long, essentially 4 inches wide, and essentially 0.0625 inches thick.

In another embodiment of the invention, the exercise apparatus further comprises a third strap measuring essentially 2.5 inches long, essentially 1 inch wide, and essentially 0.0625 inches thick, affixed at the two ends of its length to the second strap essentially along the "y" axis of the second strap's width, whereby a fourth strap, measuring essentially 22 inches long, essentially 1.5 inches wide, and essentially 0.0625 inches thick, is operable to loop in between the third strap and the second strap, such that each of the user's feet fits between the fourth strap and the second strap on either side of the third strap, and such that the balls of the user's feet touch the second strap instead of the door's surface.

In another embodiment of the invention, the fourth strap further comprises a buckle operable to adjustably tightening the fourth strap across the top of the user's feet, such that the user's feet are securely adhered to the second strap.

In another embodiment of the invention, the exercise apparatus further comprises a fifth strap measuring essentially 10 inches long, essentially 1.5 inches wide, and essentially 0.0625 inches thick, said fifth strap affixed at a place on the second strap, wherefrom the fifth strap extends downward toward the bottom edge of the door, said fifth strap comprising any of the following: a bracket which is operable to removeably grip the span of the door's thickness at the bottom edge of the door, and; the fifth strap extending an additional essentially 5 inches in length underneath the bottom of the door and up the opposite side of the door, wherein the fifth strap is fastened to the first strap's segment situated on that opposite side of the door.

In another embodiment of the invention, the fifth strap further comprises a buckle operable to adjustably tighten the fifth strap about the bottom edge of the door.

In another embodiment of the invention, the exercise apparatus further comprises a strip having a tacky surface, said strip measuring essentially 8 inches long, essentially 1.5 inches wide, and essentially 0.0156 inches thick, wherein said strip is affixed along the length of the first strap, such that the tacky surface of the strip interfaces directly with the door's surface.

In another embodiment of the invention, the exercise apparatus further comprises two strips each having a tacky surface interfacing directly with the door's surface, and each strip being affixed along the length of the first strap, wherein said two strips are spaced essentially 21 inches apart, such upon the first strap circumnavigating the door along the door's width, each of said strips wraps around the thickness of an edge of the door mating with the door frame.

In another embodiment of the invention, a door-mounted exercise apparatus, comprises: a) a first strap, measuring essentially 1.5 inches wide, essentially 73 inches long, and essentially 0.0625 inches thick, operable to removeably circumnavigate a door along its width, said first strap further comprising: a buckle operable to adjustably tighten the first strap circumferentially around the door's width, such that a user's feet can be inserted between the first strap and the door to securely adhere the feet up against a front or back surface of the door, and; b) a second strap affixed at a place on the first strap, wherefrom the second strap extends downward toward the bottom edge of the door, said second strap measuring essentially 10 inches long, essentially 1.5 inches wide, and essentially 0.0625 inches thick, and comprising a buckle operable to adjustably tighten the second strap, wherein said second strap further comprises any of the following: a bracket which is operable to removeably grip the span of the door's thickness at the bottom edge of the door, and; the second strap extending an additional essentially 5 inches in length underneath the bottom of the door and up the opposite side of the door, wherein the second strap is fastened to the first strap's segment situated on the opposite side of the door; Whereby the door-mounted exercise apparatus enables the user to perform sit-ups with the user's feet securely adhered to the surface of the door.

In another embodiment of the invention, the bracket comprises any of the following: a U-shaped metal bracket, and; a U-shaped plastic bracket.

In another embodiment of the invention, the exercise apparatus further comprises an electronic communications device removeably affixable to the first strap and operable to communicate to the user, said communications device comprising any of the following: a visual display, and; an audio speaker.

In another embodiment of the invention, the exercise apparatus further comprises an electronic sensor operable to automatically tabulate any of the following: the number of sit-ups the user performs, and; the passage of time.

In another embodiment of the invention, the exercise apparatus further comprises any of the following: operability to electrically connect the electronic sensor with the electronic communications device; operability to electronically connect with a power source, and; operability to electronically store and retrieve digital data.

In another embodiment of the invention, the electronic communications device is operable to comprise any of the following: communicating a motivational message to the user; communicating numerical data to the user; communicating the passage of time to the user.

In another embodiment of the invention, a door-mounted exercise apparatus comprises: a) a first strap, measuring essentially 1.5 inches wide, essentially 73 inches long, and essentially 0.0625 inches thick, operable to removeably circumnavigate a door along its width, said first strap further comprising: a buckle operable to adjustably tighten the first strap circumferentially around the door's width, such that a user's feet can be inserted between the first strap and the door to securely adhere the feet up against a front or back surface of the door, and; a fastening device operable to removeably fasten an elastic band to the first strap, such that the elastic band can be stretched by the user to exercise arm and leg muscles, wherein said fastening device comprises any of the following: Velcro®; snap; button; buttonhole; carabiner; clip, and; ring, and; b) a second strap affixed at a place on the first strap, wherefrom the second strap extends downward toward the bottom edge of the door, said second strap measuring essentially 10 inches long, essentially 1.5 inches wide, and essentially 0.0625 inches thick, and comprising a buckle operable to adjustably tighten the second strap, wherein said second strap further comprises any of the following: a bracket which is operable to removeably grip the span of the door's thickness at the bottom edge of the door, and; the second strap extending an additional essentially 5 inches in length underneath the bottom of the door and up the opposite side of the door, wherein the second strap is fastened to the first strap's segment situated on that opposite side of the door; Whereby the door-mounted exercise apparatus enables the user to perform sit-ups and other muscle strengthening exercises.

In another embodiment of the exercise apparatus, affixing comprises any of the following: stitching; sonic welding; adhesive, and; seam taping.

In another embodiment of the exercise apparatus, wherein the fifth strap extends an additional essentially 5 inches in length underneath the bottom of the door, the fifth strap further comprises a strip having a tacky surface, said strip measuring essentially 5 inches long, essentially 1.5 inches wide, and essentially 0.0156 inches thick, wherein said strip is affixed along the length of the fifth strap, such that the tacky surface of the strip interfaces directly with the door's surface.

In another embodiment of the exercise apparatus, wherein the second strap extends an additional essentially 5 inches in length underneath the bottom of the door, the second strap further comprises a strip having a tacky surface, said strip measuring essentially 5 inches long, essentially 1.5 inches wide, and essentially 0.0156 inches thick, wherein said strip is affixed along the length of the second strap, such that the tacky surface of the strip interfaces directly with the door's surface.

It will be appreciated that the invention disclosed herein through illustrative embodiments may suitably be practiced in the absence of any element which is not specifically disclosed herein, particularly in a preferred embodiment.

These and other advantages of the invention will become more fully apparent when the following detailed description of the invention is read in conjunction with the accompanying drawings.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

GLOSSARY

Figure 1:
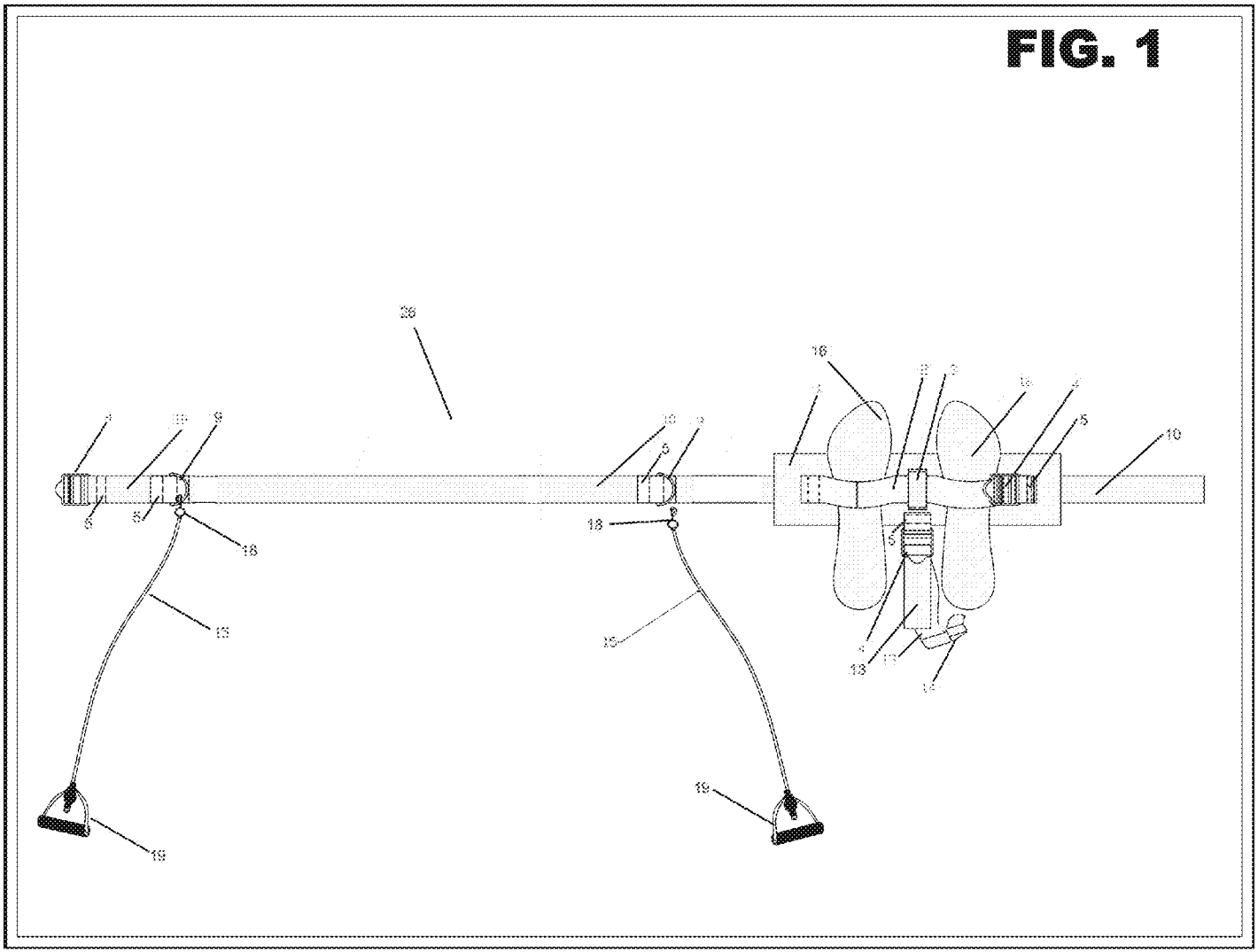
FIG. 1 is illustrative of an embodiment of the door-mounted exercise apparatus, as viewed from the front in a 2-dimensional depiction.

The following terms are defined herein under:

The article "A", or "An", means: "at least one" of anything to which it refers, such as a component, feature, element, apparatus, piece, or the like of the invention. For example, "a strap" means "at least one strap".

The term "Plurality", means: "two or more" of anything to which it refers. For example, "plurality of straps" means "two or more straps".

The term "Comprising" (or "Comprises"), means: "including, but not limited to" any one thing to which it refers, inclusive of meaning singularly, in combination, in any combination, and/or in any order. For example, "comprises any of the following: a strap; a bracket, and; a buckle" means "at least one of: a strap; a bracket, and/or; a buckle", and/or "any combination of: at least one strap; at least one bracket, and/or; at least one buckle", while not being limited to any particular combination or any particular number of each item listed.

The term "Essentially", means, and may be substituted for, any of the following equivalent terms: "approximately", "almost", "nearly", and/or "about", with respect to any dimensions related thereto.

DETAILED DESCRIPTION OF THE INVENTION

The present invention may be described herein in terms of various functional elements, or components, as depicted in the attached drawings, configurations and described embodiments. It should be appreciated that such functional elements may be realized by any number of similar elements configured according to this invention to perform the specified functions. Thus, it should be appreciated that the particular implementations shown and described herein are illustrative of the invention and its preferred mode and are not intended to otherwise limit the scope of the present invention in any way. Indeed, for the sake of brevity, conventional elements of a structure, device, or design may not be described in detail herein. Furthermore, the various figures contained herein are intended to represent illustrative functional embodiments of the invention, and that many alternative or equivalent configurations, elements, and structures are intended to be within the scope of the present invention. It should further be noted that the order of the elements in the attached drawings, specification and claims are not intended as limitations and the drawings, specification and claims may be configured in other orders without deviating from the scope and spirit of the present invention.

In the following detailed description of a preferred embodiments, reference may be made to the accompanying drawings, which form a part hereof, and within which are shown by way of illustration specific embodiments by which the invention may be practiced. It is to be understood that other embodiments may be utilized and structural changes may be made without departing from the scope of the invention.

It is noted that the embodiments of the exercise apparatus described herein below in detail for exemplary purposes, are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

The Door-Mounted Exercise Apparatus (or Door-Mounted Exercise Apparatus Assembly or Exercise Apparatus) 26 comprises a plurality, but not necessarily all, of the following components, in any combination and/or in any amount, depending on which embodiment of the Exercise Apparatus 26 is being described:

Foot Placement Strap 1
Foot Securing Strap 2
Anchoring Strap 3
Buckle 4
Affixing Band 5
Ring 9
Main Strap 10
Strip (or Tacky Surface Strip) 11
Bottom of Door Securing Strap 13
Bracket (or Fastener) 14
Elastic Exercise Band 15
User's Feet Placement 16
Door 17
Front Surface of Door 17*a*
Back Surface of Door 17*b*
Door's Thickness 17*c*
Elastic Band Fastener 18
Hand Grip (or Handle) 19
Front of Door Frame 20*a*
Back of Door Frame 20*b*
Bottom Edge of Door 17*c*
Electronic Display (optionally including Audio Speaker) 21
Door-Mounted Exercise Apparatus (or Door-Mounted Exercise Apparatus Assembly or Exercise Apparatus) 26

FIG. 1 shows an illustrative embodiment of the Exercise Apparatus 26, viewed from the front, lying flat. On the far left of the FIG. 1, there is a Buckle 4 attached to the Main Strap 10 via Affixing Band 5, shown here as sewn onto Main Strap 10 with dashed lines. Alternatively, the Affixing Band 5 may be attached to the Main Strap by means comprising any of the following: sonic welding; adhesive, and; seam taping. Moving rightward, there is a Ring 9 attached to Main Strap 10 via Affixing Band 5, shown here as sewn onto Main Strap 10 with dashed lines. The Ring 9 is attached to the Elastic Exercise Band 15 via Elastic Band Fastener 18, shown here as a clip. The Elastic Band Fastener 18 may alternatively comprise any of the following: hook and loop, such as Velcro®; snap; button; buttonhole; carabiner. Attached to the Elastic Exercise Band 15 is a Handle 19. Moving rightward, there is another Ring 9 attached to Main Strap 10 via Affixing Band 5, shown here as sewn onto Main Strap 10 with dashed lines, along with another Elastic Exercise Band 15, Elastic Band Fastener 18, and Handle 19. Moving rightward, the Foot Placement Strap 1 is affixed to Main Strap 10. Affixed to the Foot Placement Strap 1 is Foot Securing Strap 2 and Anchoring Strap 3. The Anchoring Strap 3 is affixed at both of its ends to the Foot Placement Strap 1, so that the Foot Securing Strap 2 can be looped through the opening between the Foot Placement Strap 1 and the Anchoring Strap 3. The Foot Securing Strap 2 can be tightened using Buckle 4, which is attached to the Foot Placement Strap 1 via Affixing Band 5. The user's feet are shown as User's Feet Placement 16, and are positioned between the Foot Placement Strap 1 and the Foot Securing Strap 2. Also attached to the Foot Placement Strap 1 is the Bottom of Door Securing Strap 13, shown here with Bracket 14 at one end, and looping through Buckle 4 wherein is shown some slack of the Bottom of Door Securing Strap 13 coming out the other side of Buckle 4. On the far right side of FIG. 1 is shown the continuation of Main Strap 10, of which this free end would then connect to the Buckle 4 on the far left side of FIG. 1 when wrapped around the back side of a door, as depicted in FIG. 3 and FIG. 4.

Figure 2:
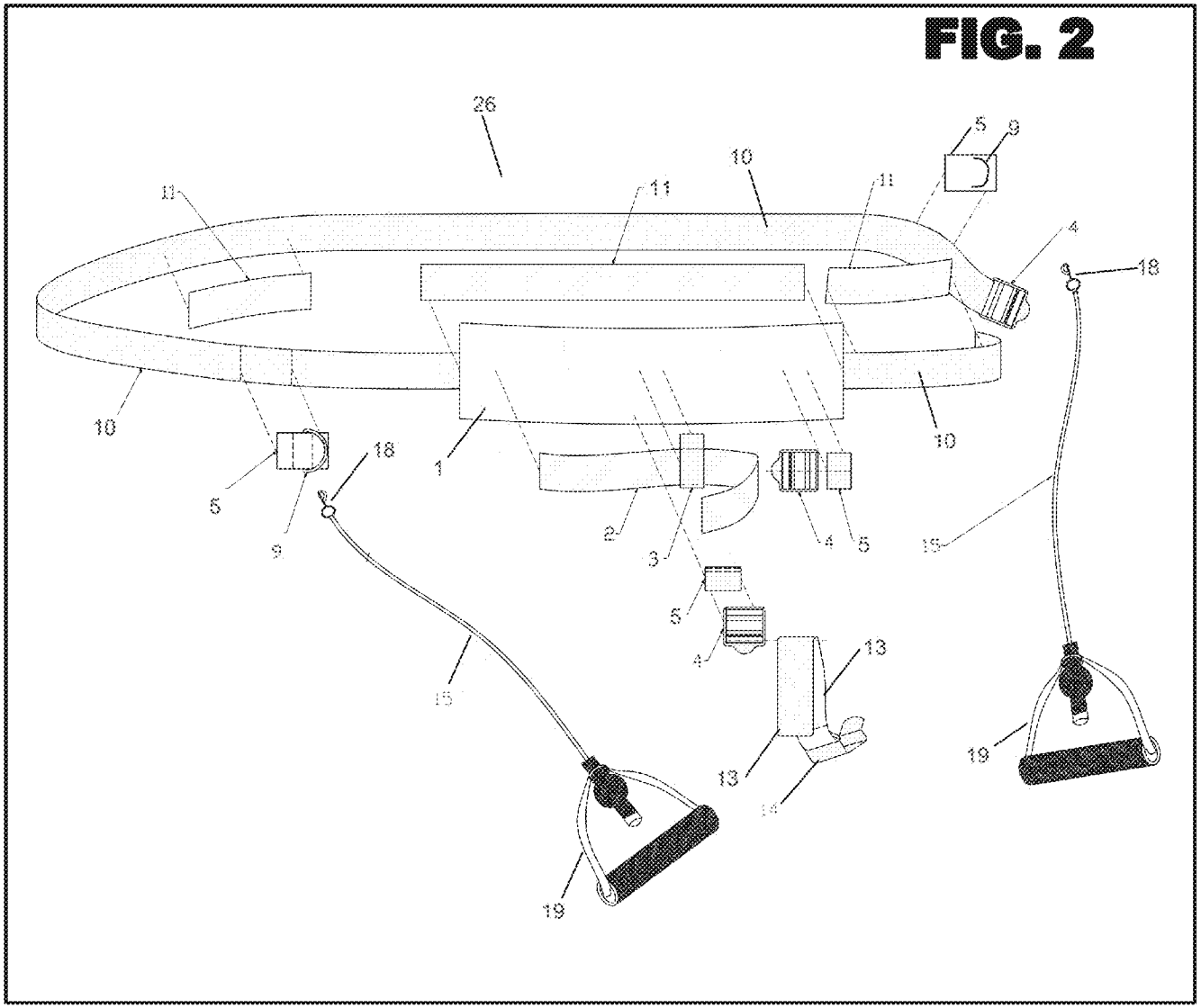
FIG. 2 is illustrative of an embodiment of the door-mounted exercise apparatus, as viewed from the front in an exploded depiction.

FIG. 2, shows an embodiment of the Exercise Apparatus 26 in an exploded view in perspective, with the dashed lines depicting points of placement and affixation, such as with stitching. In this figure, the Exercise Apparatus 26 is shown in its circular configuration, such as the Exercise Apparatus would look when circumnavigating a Door 17 (not shown) along the width of the Door 17. In this configuration, it can be seen on the far right of FIG. 2 that the Buckle 4 would connect with the free end of Main Strap 10. Also shown are the Tacky Surface Strips 11 attached at various points on the inside of the Main Strap 10. When the Tacky Surface Strip 11 faces the Door 17, this prevents the Main Strap 10 from slipping during abdominal crunches and other exercises.

Figure 3A:
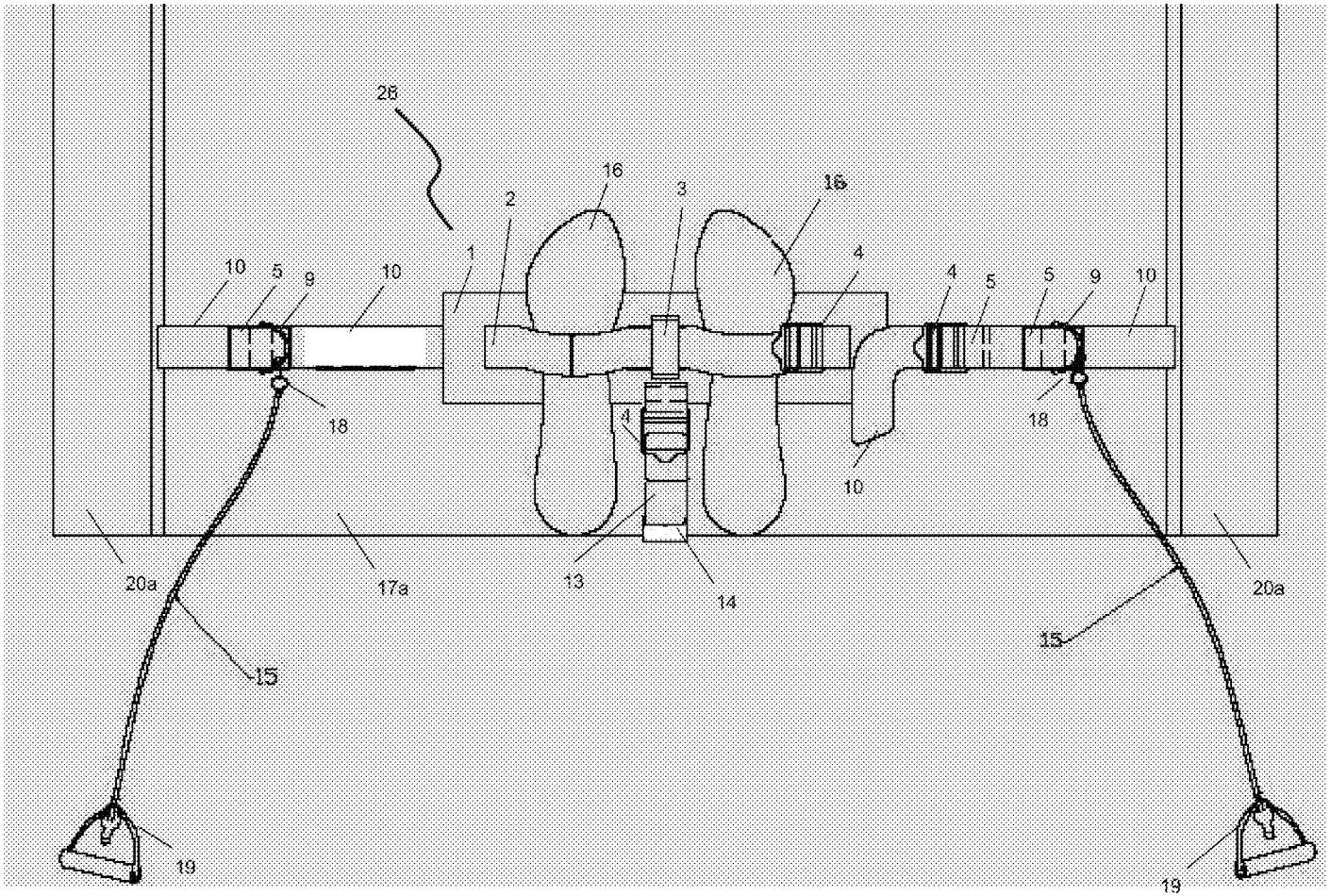
FIG. 3A and FIG. 3B are illustrative of embodiments of the door-mounted exercise apparatus, as viewed mounted on a door from the front side of a door in a 2-dimensional depiction.

FIG. 3A shows an embodiment of the Exercise Apparatus 26 as seen from the Front Surface of Door 17*a*, with Front of Door Frame 20*a* being visible. Here, the Main Strap 10 circumnavigates the Door 17 along its width, and passes through the gaps on the far left and on the far right, each gap being between the Front Surface of Door 17*a* and Front of Door Frame 20*a*. The Bracket 14 is shown at the center affixed to the bottom edge of the Front Surface of Door 17*a*.

Figure 3B:
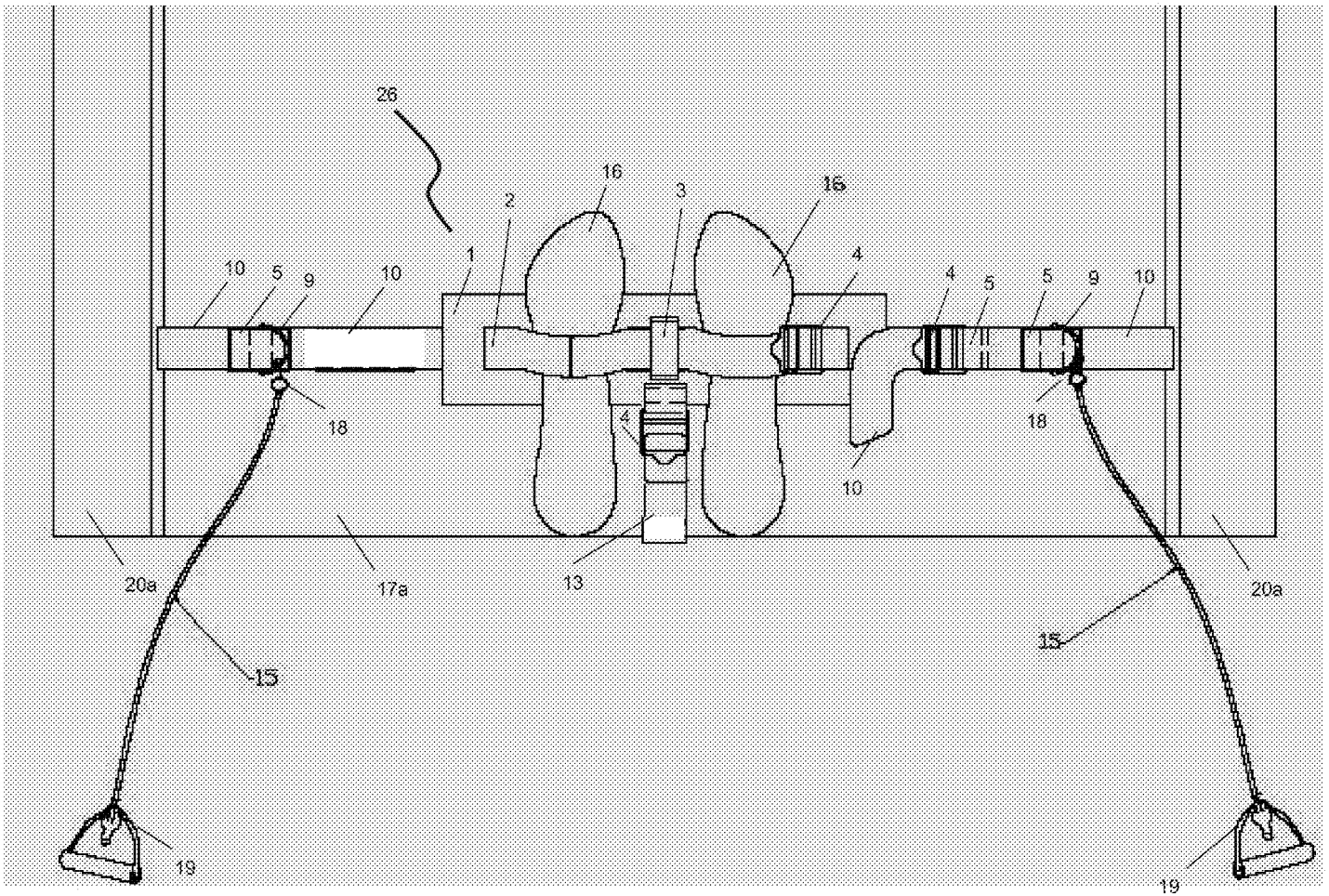

FIG. 3B shows an embodiment of the Exercise Apparatus 26 as seen from the Front Surface of Door 17*a*, with the Bottom of Door Securing Strap 13 shown at the center affixed to the bottom edge of the Front Surface of Door 17*a*.

Figure 4A:
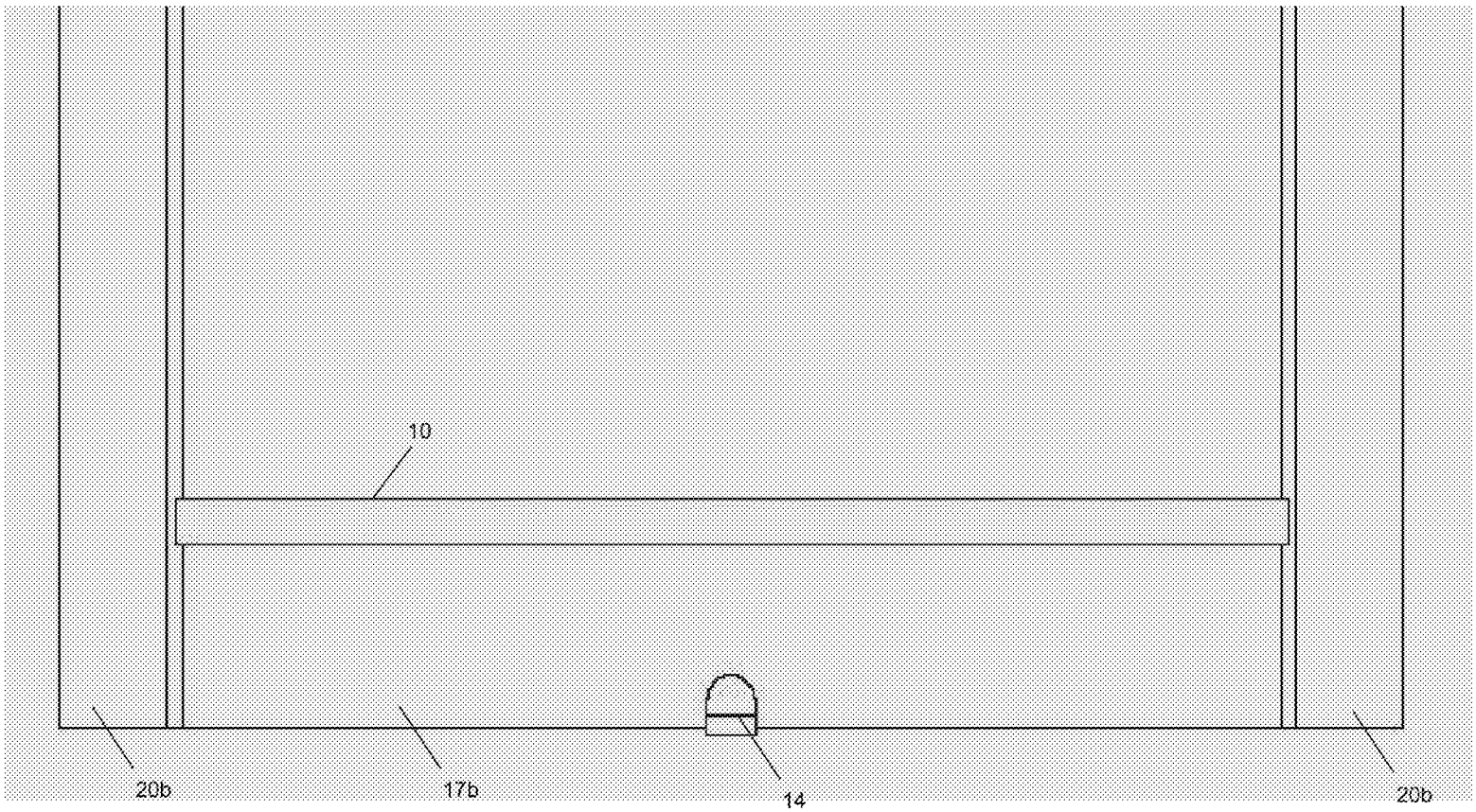
FIG. 4A and FIG. 4B are illustrative of embodiments of the door-mounted exercise apparatus, as viewed from the back side of a door in a 2-dimensional depiction.

FIG. 4A shows an embodiment of the Exercise Apparatus 26 as seen from the Back Surface of Door 17*b*. Here, the Main Strap 10 is seen continuing to circumnavigate the Door 17 along its width, and it passes through the gaps on the far left and on the far right, each gap being between the Back Surface of Door 17*b* and Back of Door Frame 20*b*. The Bracket 14 is shown at the center affixed to the bottom edge of the Back Surface of Door 17*b*.

Figure 4B:
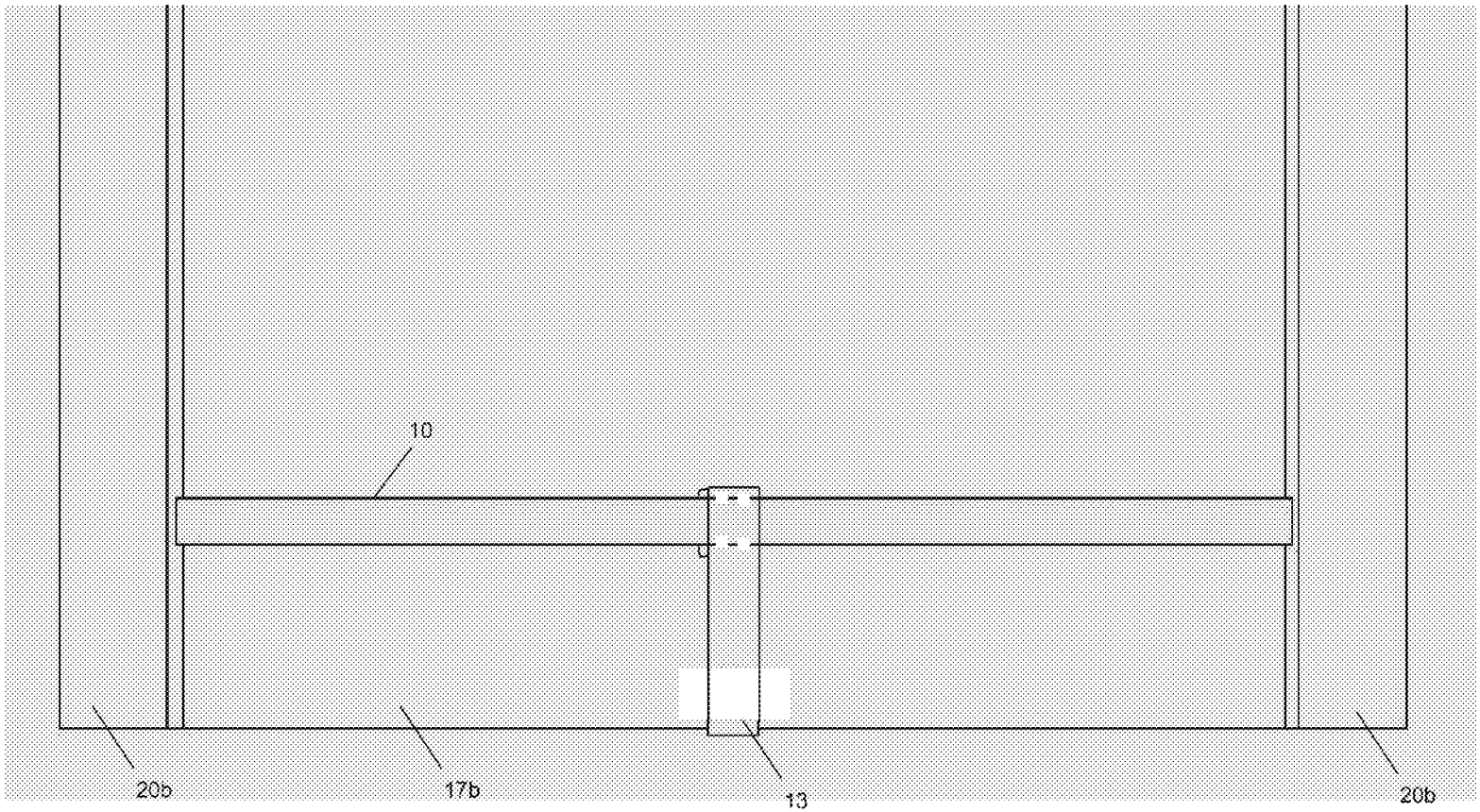

FIG. 4B shows an embodiment of the Exercise Apparatus 26 as seen from the Back Surface of Door 17*b*, with the Bottom of Door Securing Strap 13 shown at the center affixed to the bottom edge of the Back Surface of Door 17*b*. The Bottom of Door Securing Strap 13 is also shown looping around the Main Strap 10, whereby the Bottom of Door Securing Strap 13 anchored to the Main Strap 10.

Figure 5:
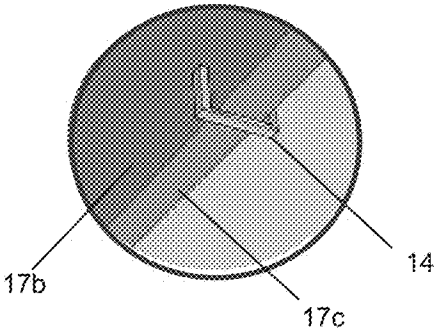
FIG. 5 is illustrative of an embodiment of the door bracket component of the door-mounted exercise apparatus, as mounted on the bottom edge of a door, in a ¾ view depiction.

FIG. 5 shows an embodiment of the Exercise Apparatus 26 as seen in perspective from the Back Surface of Door 17*b* and from the Bottom Edge of Door 17*c*, where the Bracket 14 spans the thickness of the Bottom Edge of Door 17*c*.

Figure 6:
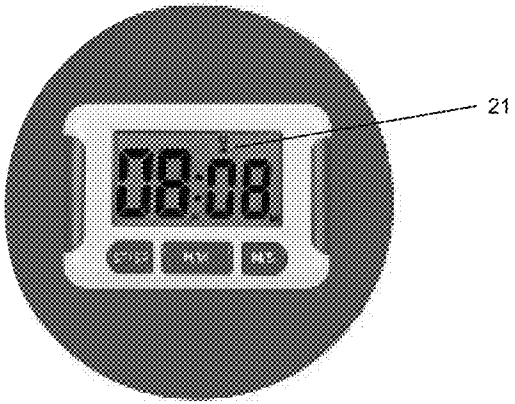
FIG. 6 is illustrative of an embodiment of the electronic communications device with a visual display.

FIG. 6 shows an embodiment of the Electronic Display 21 with a visual display of time. The Electronic Display 21 may also provide a visual or audio display the number of repetitions of an exercise being performed.

With the Exercise Apparatus securely adhered to the Door 17 (not shown) by adjusting the lengths of the Main Strap 10 and the Bottom of Door Securing Strap 13 with their respective Buckles 4, the user then positions their feet as shown in the User's Feet Placement 16, and tightens Foot Securing Strap 2 around their feet using the Buckle 4. The user can then perform abdominal or stomach crunches with greater ease, since their lower body is now stabilized. The user can then attach the Elastic Exercise Bands 15 using Elastic Band Fasteners 18, so that the user can grip the Handles 19 and pull on the Elastic Exercise Bands 15 to perform upper body exercises for strengthening muscles in the arms and chest. Resistance levels can be varied by using different types of Elastic Exercise Bands 15, and by performing exercises standing up or sitting down. The user can also place their feet in the Handles 19 and perform exercises strengthening leg muscles.

From the foregoing, it will be appreciated how the invention provides an improved exercise apparatus, by providing a portable exercise apparatus which can be removeably attached to a door, and which enables multiple exercises for the user, including: sit-ups, and strengthening arm and leg muscles.

Further, the improved portable exercise apparatus provides an improved means for doing sit-ups, and an electronic communications display (audio and/or visual) for timing and counting the user's exercise progress.

Although the description above contains many specificities, these should not be construed as limiting the scope of the invention but as merely providing illustrations of some of the presently illustrated embodiments of this invention. Thus the scope of this invention should be considered in light of the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known to those of ordinary skill in the art are expressly incorporated herein by reference and are intended to be encompassed by the present claims. Moreover, it is not necessary for a device to address each and every problem sought to be solved by the present invention, for it to be encompassed by the present claims. Furthermore, no element or component in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

It is understood that the preceding description is given merely by way of illustration and not in limitation of the invention and that various modifications may be made thereto without departing from the spirit of the invention as claimed.

Although the invention has been described with respect to a particular structure for its use, it will be appreciated that various modifications of the structure are possible without departing from the invention, which is defined by the claims set forth below. For example, the invention can be practiced without any one of its elements, or without any plurality of its elements, and said embodiment(s) are incorporated within the scope of the invention.

What is claimed is:

1. A door-mounted exercise apparatus, comprising: a first strap, operable to removeably circumnavigate a door along its width, said first strap further comprising:

a) a buckle operable to adjustably tighten the first strap circumferentially around the door's width, such that a user's feet can be inserted between the first strap and the door to securely adhere the feet up against a front or back surface of the door;

b) a fastening device, said fastening device affixed to the first strap and operable to removeably fasten an elastic band to the first strap, such that the elastic band can be stretched by the user to exercise arm and leg muscles, wherein said fastening device comprises any of the following: Velcro®; snap; button; buttonhole; carabiner; clip, and; ring;

c) a second strap affixed to the first strap along the first strap's length, and;

d) a third strap, affixed at the two ends of its length to the second strap essentially along the "y" axis of the second strap's width, whereby a fourth strap, is operable to loop in between the third strap and the second strap, such that each of the user's feet fits between the fourth strap and the second strap on either side of the third strap, and such that the balls of the user's feet touch the second strap instead of the door's surface;

Whereby the door-mounted exercise apparatus enables the user to perform sit-ups and other muscle strengthening exercises.

2. The exercise apparatus of claim 1, wherein the fourth strap further comprises a buckle operable to adjustably tightening the fourth strap across the top of the user's feet, such that the user's feet are securely adhered to the second strap.

3. The exercise apparatus of claim 2, further comprising a fifth strap affixed at a place on the second strap, wherefrom the fifth strap extends downward toward the bottom edge of the door, said fifth strap comprising any of the following: a bracket which is operable to removeably grip the span of the door's thickness at the bottom edge of the door, and; the fifth strap extending an additional length underneath the bottom of the door and up the opposite side of the door, wherein the fifth strap is fastened to the first strap's segment situated on that opposite side of the door.

4. The exercise apparatus of claim 3, wherein the fifth strap further comprises a buckle operable to adjustably tighten the fifth strap about the bottom edge of the door.

5. The exercise apparatus of claim 1, further comprising a strip having a tacky surface, wherein said strip is affixed along the length of the first strap, such that the tacky surface of the strip interfaces directly with the door's surface.

6. The exercise apparatus of claim 5, further comprising two such strips affixed along the length of the first strap, such upon the first strap circumnavigating the door along the door's width, each of said strips wraps around the thickness of an edge of the door mating with the door frame.

7. A door-mounted exercise apparatus, comprising:

a) a first strap, operable to removeably circumnavigate a door along its width, said first strap further comprising: a buckle operable to adjustably tighten the first strap circumferentially around the door's width, such that a user's feet can be inserted between the first strap and the door to securely adhere the feet up against a front or back surface of the door;

b) a second strap affixed at a place on the first strap, wherefrom the second strap extends downward toward the bottom edge of the door, said second strap comprising a buckle operable to adjustably tighten the second strap, wherein said second strap further comprises any of the following: a bracket which is operable to removeably grip the span of the door's thickness at the bottom edge of the door, and; the second strap extending an additional length underneath the bottom of the door and up the opposite side of the door, wherein the second strap is fastened to the first strap's segment situated on the opposite side of the door, and;

c) the second strap, extending an additional length underneath the bottom of the door, further comprises a strip having a tacky surface, wherein said strip is affixed along the length of the second strap, such that the tacky surface of the strip interfaces directly with the door's surface;

Whereby the door-mounted exercise apparatus enables the user to perform sit-ups with the user's feet securely adhered to the surface of the door.

8. The exercise apparatus of claim 3, wherein the bracket comprises any of the following: a U-shaped metal bracket, and; a U-shaped plastic bracket.

9. The exercise apparatus of claim 1, further comprising an electronic communications device removeably affixable to the first strap and operable to communicate to the user, said communications device comprising any of the following: a visual display, and; an audio speaker.

10. The exercise apparatus of claim 9, further comprising an electronic sensor operable to automatically tabulate any of the following: the number of sit-ups the user performs, and; the passage of time.

11. The exercise apparatus of claim 10, further comprising any of the following: operability to electrically connect the electronic sensor with the electronic communications device; operability to electronically connect with a power source, and; operability to electronically store and retrieve digital data.

12. The exercise apparatus of claim 10, wherein the electronic communications device is operable to comprise any of the following: communicating a motivational message to the user; communicating numerical data to the user; communicating the passage of time to the user.

13. A door-mounted exercise apparatus, comprising:

a) a first strapoperable to removeably circumnavigate a door along its width, said first strap further comprising: a buckle operable to adjustably tighten the first strap circumferentially around the door's width, such that a user's feet can be inserted between the first strap and the door to securely adhere the feet up against a front or back surface of the door, and; a fastening device operable to removeably fasten an elastic band to the first strap, such that the elastic band can be stretched by the user to exercise arm and leg muscles, wherein said fastening device comprises any of the following: Velcro®; snap; button; buttonhole; carabiner; clip, and; ring;

b) a second strap affixed at a place on the first strap, wherefrom the second strap extends downward toward the bottom edge of the door, said second strap comprising a buckle operable to adjustably tighten the second strap, wherein said second strap further comprises any of the following: a bracket which is operable to removeably grip the span of the door's thickness at the bottom edge of the door, and; the second strap extending an additional length underneath the bottom of the door and up the opposite side of the door, wherein the second strap is fastened to the first strap's segment situated on that opposite side of the door, and;

c) the second strap, extending an additional essentially 5 inches in length underneath the bottom of the door, further comprises a strip having a tacky surface, wherein said strip is affixed along the length of the second strap, such that the tacky surface of the strip interfaces directly with the door's surface;

Whereby the door-mounted exercise apparatus enables the user to perform sit-ups and other muscle strengthening exercises.

14. The exercise apparatus of claim 1, wherein affixing comprises any of the following: stitching; sonic welding; adhesive, and; seam taping.

15. The exercise apparatus of claim 3, wherein the fifth strap, extending an additional length underneath the bottom of the door, further comprises a strip having a tacky surface, wherein said strip is affixed along the length of the fifth strap, such that the tacky surface of the strip interfaces directly with the door's surface.

* * * * *